US008251103B2

(12) United States Patent
Baumann

(10) Patent No.: US 8,251,103 B2
(45) Date of Patent: Aug. 28, 2012

(54) PAPERMAKER'S FORMING FABRIC WITH ENGINEERED DRAINAGE CHANNELS

(75) Inventor: Oliver Baumann, Gomaringen (DE)

(73) Assignee: Weavexx Corporation, Wake Forest, NC (US)

( * ) Notice: Subject to any disclaimer, the term of this patent is extended or adjusted under 35 U.S.C. 154(b) by 147 days.

(21) Appl. No.: 12/915,490

(22) Filed: Oct. 29, 2010

(65) Prior Publication Data

US 2011/0100577 A1 May 5, 2011

Related U.S. Application Data

(60) Provisional application No. 61/257,957, filed on Nov. 4, 2009.

(51) Int. Cl.
*D21F 1/10* (2006.01)
*D21F 7/08* (2006.01)
*D03D 25/00* (2006.01)

(52) U.S. Cl. ..... 139/383 A; 139/383 R; 139/383 AA; 162/358.2

(58) Field of Classification Search ..... 139/383 R, 139/383 A, 383 AA; 162/358.2
See application file for complete search history.

(56) References Cited

U.S. PATENT DOCUMENTS 2,172,430 A 9/1939 Barrell
2,554,034 A 5/1951 Koester et al.
3,094,149 A 6/1963 Keily
3,325,909 A 6/1967 Clark
3,851,681 A 12/1974 Egan
3,885,602 A * 5/1975 Slaughter ..... 139/425 A
3,920,508 A * 11/1975 Yonemori ..... 162/157.5
4,054,625 A * 10/1977 Kozlowski et al. ..... 264/13
4,093,512 A 6/1978 Fleischer
4,182,381 A 1/1980 Gisbourne
4,231,401 A 11/1980 Matuska
4,244,543 A 1/1981 Ericson
4,289,173 A 9/1981 Miller
4,290,209 A 9/1981 Buchanan et al.
(Continued)

FOREIGN PATENT DOCUMENTS

DE 454 092 12/1927
(Continued)

OTHER PUBLICATIONS

Partial International Search for PCT/US2009/000093 mailed May 15, 2009.

(Continued)

*Primary Examiner* — Bobby Muromoto, Jr.
(74) *Attorney, Agent, or Firm* — Myers Bigel Sibley & Sajovec

(57) ABSTRACT

A papermaking forming fabric includes: a set of top MD yarns; a set of top CMD yarns interwoven with the top MD yarns to form a top fabric layer; a set of bottom MD yarns; a set of bottom CMD yarns interwoven with the bottom MD yarns to form a bottom fabric layer; and a set of binding yarns that interweaves with and binds together the top and bottom fabric layers. The fabric has a Channel Factor (CF) of greater than 2.0, the CF being defined in Equation (1) as:

$$CF=(PSMW/PSML)\times(SOA\ \%\ PS/SOA\ \%\ RS) \quad (1)$$

wherein:
PSMW=the CMD width of an interstice between adjacent top MD yarns;
PSML=the MD width of an interstice between adjacent top CMD yarns;
SOA % PS=surface open area in the top fabric layer; and
SOA % RS=surface open area in the bottom fabric layer.

10 Claims, 2 Drawing Sheets

U.S. PATENT DOCUMENTS 4,408,637 A 10/1983 Karm
4,414,263 A 11/1983 Miller et al.
4,438,788 A 3/1984 Harwood
4,452,284 A 6/1984 Eckstein et al.
4,453,573 A 6/1984 Thompson
4,501,303 A 2/1985 Osterberg
4,515,853 A 5/1985 Borel
4,529,013 A 7/1985 Miller
4,564,052 A 1/1986 Borel
4,564,551 A 1/1986 Best
4,579,771 A * 4/1986 Finn et al. ..... 428/222
4,592,395 A 6/1986 Borel
4,592,396 A 6/1986 Borel et al.
4,605,585 A 8/1986 Johansson
4,611,639 A 9/1986 Bugge
4,621,663 A 11/1986 Malmendier
4,633,596 A 1/1987 Josef
4,636,426 A 1/1987 Fleischer
4,642,261 A 2/1987 Fearnhead
4,676,278 A 6/1987 Dutt
4,705,601 A 11/1987 Chiu
4,709,732 A 12/1987 Kinnunen
4,729,412 A 3/1988 Bugge
4,731,281 A 3/1988 Fleischer et al.
4,739,803 A 4/1988 Borel
4,755,420 A 7/1988 Baker et al.
4,759,975 A 7/1988 Sutherland et al.
4,759,976 A * 7/1988 Dutt ..... 442/206
4,815,499 A 3/1989 Johnson
4,815,503 A 3/1989 Borel
4,909,284 A 3/1990 Kositzke
RE33,195 E 4/1990 McDonald et al.
4,934,414 A 6/1990 Borel
4,941,514 A 7/1990 Taipale
4,942,077 A 7/1990 Wendt et al.
4,945,952 A 8/1990 Vöhringer
4,967,805 A 11/1990 Chiu et al.
4,987,929 A * 1/1991 Wilson ..... 139/383 A
4,989,647 A 2/1991 Marchand
4,989,648 A 2/1991 Tate et al.
4,995,429 A * 2/1991 Kositzke ..... 139/383 R
4,998,568 A 3/1991 Vohringer
4,998,569 A 3/1991 Tate
5,013,330 A * 5/1991 Durkin et al. ..... 51/297
5,022,441 A 6/1991 Tate et al.
5,025,839 A 6/1991 Wright
5,066,532 A * 11/1991 Gaisser ..... 428/137
5,067,526 A 11/1991 Herring
5,074,339 A 12/1991 Vohringer
5,084,326 A 1/1992 Vohringer
5,092,372 A 3/1992 Fitzka et al.
5,101,866 A 4/1992 Quigley
5,116,478 A 5/1992 Tate et al.
5,151,316 A * 9/1992 Durkin et al. ..... 428/213
5,152,326 A 10/1992 Vohringer
5,158,118 A 10/1992 Tate et al.
5,219,004 A * 6/1993 Chiu ..... 139/383 A
5,228,482 A 7/1993 Fleischer
5,238,536 A * 8/1993 Danby ..... 162/202
5,254,398 A 10/1993 Gaisser
5,277,967 A 1/1994 Zehle et al.
5,358,014 A 10/1994 Kovar
5,379,808 A * 1/1995 Chiu ..... 139/383 A
5,421,374 A 6/1995 Wright
5,421,375 A 6/1995 Praetzel
5,429,686 A 7/1995 Chiu et al.
5,431,786 A 7/1995 Rasch et al.
5,437,315 A * 8/1995 Ward ..... 139/383 A
5,449,026 A 9/1995 Lee
5,454,405 A 10/1995 Hawes
5,456,293 A 10/1995 Ostermayer et al.
5,465,764 A 11/1995 Eschmann et al.
5,482,567 A 1/1996 Barreto
5,487,414 A 1/1996 Kuji et al.
5,503,196 A 4/1996 Josef et al.
5,507,915 A * 4/1996 Durkin et al. ..... 162/117
5,518,042 A 5/1996 Wilson
5,520,225 A 5/1996 Quigley et al.
5,542,455 A 8/1996 Ostermayer et al.
5,555,917 A 9/1996 Quigley
5,564,475 A 10/1996 Wright
5,641,001 A 6/1997 Wilson
5,651,394 A 7/1997 Marchand
5,709,250 A 1/1998 Ward et al.
RE35,777 E 4/1998 Givin
5,746,257 A 5/1998 Fry
5,826,627 A 10/1998 Seabrook et al.
5,857,498 A 1/1999 Barreto et al.
5,881,764 A 3/1999 Ward
5,894,867 A 4/1999 Ward et al.
5,899,240 A 5/1999 Wilson
5,937,914 A 8/1999 Wilson
5,967,195 A 10/1999 Ward
5,983,953 A 11/1999 Wilson
6,073,661 A 6/2000 Wilson
6,103,067 A * 8/2000 Stelljes et al. ..... 162/348
6,112,774 A 9/2000 Wilson
6,123,116 A * 9/2000 Ward et al. ..... 139/383 A
6,145,550 A 11/2000 Ward
6,148,869 A 11/2000 Quigley
6,158,478 A 12/2000 Lee et al.
6,179,013 B1 * 1/2001 Gulya ..... 139/383 A
6,179,965 B1 1/2001 Cunnane et al.
6,202,705 B1 * 3/2001 Johnson et al. ..... 139/383 A
6,207,598 B1 3/2001 Lee et al.
6,227,255 B1 5/2001 Osterberg et al.
6,237,644 B1 5/2001 Hay et al.
6,240,973 B1 * 6/2001 Stone et al. ..... 139/383 A
6,244,306 B1 6/2001 Troughton
6,253,796 B1 7/2001 Wilson et al.
6,276,402 B1 8/2001 Herring
6,368,465 B1 * 4/2002 Stelljes et al. ..... 162/358.2
6,379,506 B1 * 4/2002 Wilson et al. ..... 162/348
6,581,645 B1 6/2003 Johnson et al.
6,585,006 B1 7/2003 Wilson et al.
6,786,242 B2 9/2004 Salway et al.
6,837,277 B2 1/2005 Troughton et al.
6,899,143 B2 5/2005 Rougvie et al.
6,904,942 B2 6/2005 Odenthal
7,001,489 B2 2/2006 Taipale et al.
7,008,512 B2 3/2006 Rougvie et al.
7,059,357 B2 6/2006 Ward
7,108,020 B2 9/2006 Stone
7,275,566 B2 * 10/2007 Ward ..... 139/383 A
7,445,032 B2 11/2008 Barrett et al.
7,581,567 B2 * 9/2009 Ward et al. ..... 139/383 A
7,604,026 B2 * 10/2009 Herman ..... 139/383 A
7,766,053 B2 8/2010 Barratte
2003/0010393 A1 1/2003 Kuji
2003/0024590 A1 * 2/2003 Stone ..... 139/408
2004/0003860 A1 * 1/2004 Taipale et al. ..... 139/383 A
2004/0079434 A1 4/2004 Martin et al.
2004/0102118 A1 * 5/2004 Hay et al. ..... 442/239
2004/0104005 A1 * 6/2004 Brewster et al. ..... 162/358.2
2004/0149343 A1 8/2004 Troughton et al.
2005/0268981 A1 * 12/2005 Barratte ..... 139/383 A
2006/0169346 A1 8/2006 Fahrer et al.
2006/0266484 A1 * 11/2006 Vinson et al. ..... 162/109
2006/0278298 A1 * 12/2006 Ampulski et al. ..... 139/383 B
2009/0183795 A1 7/2009 Ward et al.

FOREIGN PATENT DOCUMENTS

DE 3318960 A1 11/1984
DE 33 29 740 A1 3/1985
DE 10 2005 041 042 A1 3/2007
EP 0 048 962 B2 9/1981
EP 0 158 710 A1 10/1984
EP 0 185 177 B1 10/1985
EP 0 224 276 B1 12/1986
EP 0 264 881 B1 10/1987
EP 0 269 070 B1 11/1987
EP 0 284 575 B1 2/1988
EP 0 283 181 B1 3/1988
EP 0 350 673 B1 6/1989
EP 0 408 849 A2 5/1990
EP 0 408 849 A3 5/1990
EP 0 672 782 B1 3/1995

| | | | |
|---|---|---|---|
| EP | 0 794 283 | A1 | 9/1997 |
| EP | 1 605 095 | A1 | 12/2005 |
| EP | 1 630 283 | A1 | 3/2006 |
| EP | 1 849 912 | A2 | 10/2007 |
| FR | 2 597 123 | | 4/1986 |
| GB | 2157328 | A | 10/1985 |
| GB | 2245006 | A | 2/1991 |
| JP | 8-158285 | | 12/1994 |
| WO | WO 86/00099 | A1 | 1/1986 |
| WO | WO 89/09848 | A1 | 4/1989 |
| WO | WO 99/61698 | A1 | 12/1999 |
| WO | WO 02/00996 | A1 | 1/2002 |
| WO | WO 03/10304 | A2 | 2/2003 |
| WO | WO 03/093573 | A1 | 11/2003 |
| WO | WO 2005/017254 | A1 | 2/2005 |
| WO | WO 2006/015377 | A2 | 2/2006 |
| WO | WO 2006/015377 | A3 | 2/2006 |

OTHER PUBLICATIONS

International Search Report for PCT/US2004/008311; Date of Mailing Jul. 26, 2004.

International Search Report for PCT Application No. PCT/US97/18629.

Rule 132 Declaration of Robert G. Wilson (Jun. 26, 1997).

Warren, C.A., "The Importance of Yarn Properties in Wet-End Wire Construction," Seminar, The Theory of Water Removal, Dec. 12, 1979.

European Search Report corresponding to application No. EP 05002306.8, dated Oct. 18, 2005.

International Search Report and Written Opinion of the International Searching Authority of International Application No. PCT/US2007/022434 (12 pages) (Feb. 8, 2008).

The International Search Report and the Written Opinion for PCT/US2009/062020 dated Feb. 4, 2010.

International Search Report and Written Opinion of the International Searching Authority corresponding to International Application No. PCT/US2010/054906; Date of Mailing: Mar. 29, 2011; 11 pages.

International Preliminary Report on Patentability for Application No. PCT/US2010/054906, mailed May 18, 2012.

* cited by examiner

PAPERMAKER'S FORMING FABRIC WITH ENGINEERED DRAINAGE CHANNELS

RELATED APPLICATION

The present application claims priority from U.S. Provisional Application No. 61/257,957, filed Nov. 4, 2009, the disclosure of which is hereby incorporated herein in its entirety.

FIELD OF THE INVENTION

This application is directed generally to papermaking, and more specifically to fabrics employed in papermaking.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run that operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is enhanced by the presence of a "batt" layer of the press felt. The paper is then transferred to a dryer section for further moisture removal. After drying, the paper is ready for secondary processing and packaging.

As used herein, the terms machine direction ("MD") and cross machine direction ("CMD") refer, respectively, to a direction aligned with the direction of travel of the papermakers' fabric on the papermaking machine, and a direction parallel to the fabric surface and traverse to the direction of travel. Likewise, directional references to the vertical relationship of the yarns in the fabric (e.g., above, below, top, bottom, beneath, etc.) assume that the papermaking surface of the fabric is the top of the fabric and the machine side surface of the fabric is the bottom of the fabric.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are now commercially available, which for certain fabrics may be used to automate at least part of the joining process. In a flat woven papermaker's fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure.

Typically, finely woven fabrics such as those used in fine paper and tissue applications include at least some relatively small diameter machine direction or cross machine direction yarns. Regrettably, however, such yarns tend to be delicate, leading to a short surface life for the fabric. Moreover, the use of smaller yarns can also adversely affect the mechanical stability of the fabric (especially in terms of skew resistance, narrowing propensity and stiffness), which may negatively impact both the service life and the performance of the fabric.

To combat these problems associated with fine weave fabrics, multi-layer forming fabrics have been developed with fine-mesh yarns on the paper forming surface to facilitate paper formation and coarser-mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paperside fabric layer and a separate, coarser machine side fabric layer. In these fabrics, which are part of a class of fabrics generally referred to as "triple layer" fabrics, the two fabric layers are typically bound together by separate stitching yarns. However, they may also be bound together using yarns from one or more of the sets of bottom and top cross machine direction and machine direction yarns. As double and triple layer fabrics include additional sets of yarn as compared to single layer fabrics, these fabrics typically have a higher "caliper" (i.e., they are thicker) than comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, U.S. Pat. Nos. 5,437,315 and 5,967,195 to Ward, and U.S. Pat. No. 6,745,797 to Troughton.

Drainage channels though the forming fabric can have a significant impact on the drainage behaviour of the wire. By understanding and controlling drainage, forming fabric performance can be modified and/or improved.

SUMMARY OF THE INVENTION

As a first aspect, embodiments of the present invention are directed to a papermaker's fabric with improved drainage characteristics. The papermaker's fabric comprises: a set of top MD yarns; a set of top CMD yarns interwoven with the top MD yarns to form a top fabric layer; a set of bottom MD yarns; a set of bottom CMD yarns interwoven with the bottom MD yarns to form a bottom fabric layer; and a set of binding yarns that interweaves with and binds together the top and bottom fabric layers. The fabric has a Channel Factor (CF) of greater than 2.0, the CF being defined in Equation (1) as:

$$CF=(PSMW/PSML)\times(SOA\ \%\ PS/SOA\ \%\ RS) \quad (1)$$

wherein:

PSMW=the CMD width of an interstice between adjacent top MD yarns;

PSML=the MD width of an interstice between adjacent top CMD yarns;

SOA % PS=surface open area in the top fabric layer; and

SOA % RS=surface open area in the bottom fabric layer.

With these parameters, the fabric may enjoy improved drainage characteristics compared to prior papermaking fabrics.

As a second aspect, embodiments of the present invention are directed to a papermaker's fabric comprising: a set of top MD yarns; a set of top CMD yarns interwoven with the top MD yarns to form a top fabric layer; a set of bottom MD yarns; a set of bottom CMD yarns interwoven with the bottom MD yarns to form a bottom fabric layer; and a set of binding yarns that interweaves with and binds together the top and bottom fabric layers. The fabric has a Drainage Factor (DF) of greater than 2.0, the DF being defined in Equation (2) as:

$$DF = \text{Warp coverage RS (\%)}/\text{warp coverage PS (\%)} \quad (2)$$

wherein:

Warp coverage RS(%)=bottom MD yarns/cm×bottom MD yarn diameter (mm)×10; and

Warp coverage PS(%)=top MD yarns/cm×top MD yarn diameter (mm)×10.

DETAILED DESCRIPTION OF EMBODIMENTS OF THE INVENTION

Figure 1:
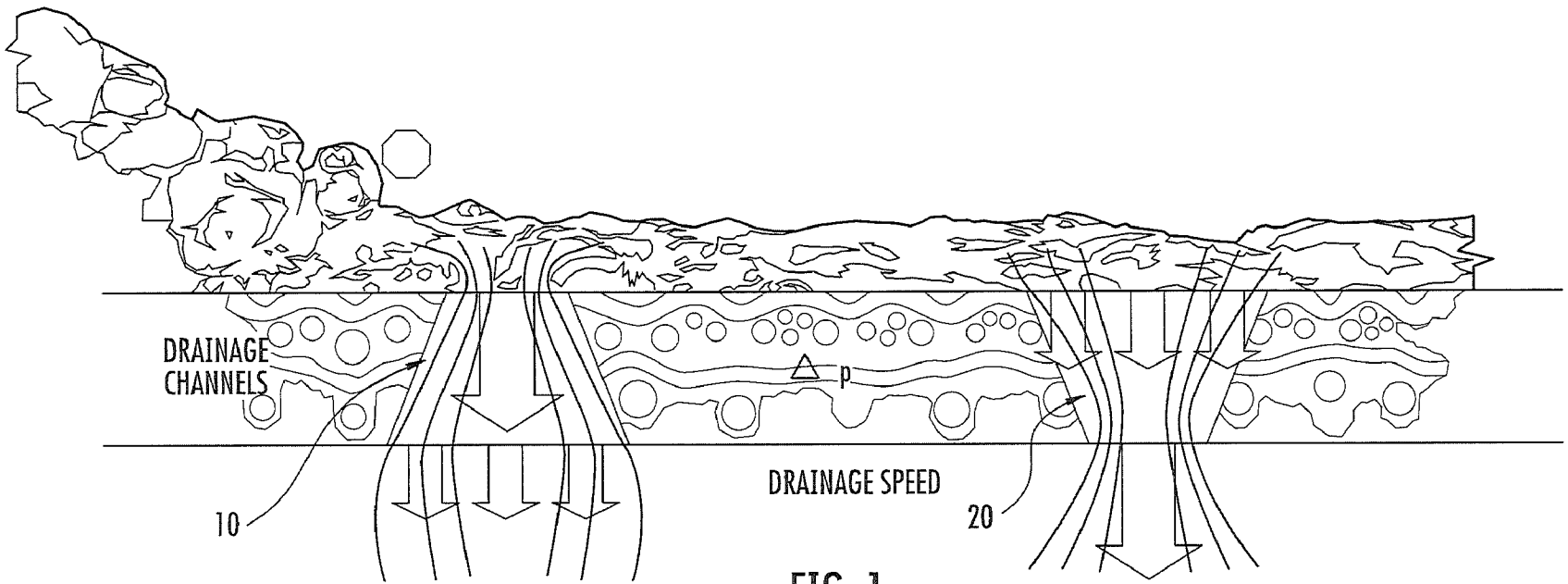
FIG. 1 is a schematic illustration of a papermaking fabric with two drainage channels shown: a conventional channel on the left in which the paper side (i.e., top side) interstice is smaller than the running side (i.e., bottom side) interstice; and an inventive channel on the right in which the paper side interstice is larger than the running side interstice.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The present invention is directed to papermaker's forming fabrics. As described above, a typical papermaker's forming fabric comprises MD and CMD yarns that are interwoven with each other in a predetermined pattern to create a sieve-like structure. Triple layer forming fabrics include a top fabric layer formed of interwoven top MD and top CMD yarns and a bottom fabric layer formed of interwoven bottom MD and bottom CMD yarns. The top and bottom fabric layers are bound together with binding or stitching yarns. In some instances (for example, the fabrics discussed in U.S. Pat. No. 5,967,195 to Ward and U.S. Pat. No. 7,059,357), the binding yarns help to form the weave pattern of the top fabric layer.

The interweaving of the top MD and top CMD yarns (and in appropriate instances the binding yarns, when the binding yarns are integral to the weave pattern) forms holes or interstices in the top fabric layer that are defined or framed by the top MD and CMD yarns. Similarly, the bottom MD and bottom CMD yarns define holes or interstices in the bottom fabric layer (typically the binding yarns do not frame the interstices in the bottom fabric layer). An interstice in the top fabric layer is typically in fluid communication with an interstice in the bottom fabric layer; together, these top layer and bottom layer interstices form a "channel" through which water from paper stock can drain.

The inventors have determined that the shape of the "channel" created by the mesh of a forming fabric can influence drainage, and that by intentionally engineering the shape of the channel, drainage can be positively affected. Not only is drainage influenced by the channel shape, but also the sheet build-up in the initial drainage zone can be very much controlled by the free surfaces through the wire. In one embodiment, it has been determined that a channel shape that is larger on the paper side of the fabric than on the running side can improve drainage characteristics. Such a channel 20 is schematically shown in FIG. 1 beside a conventional drainage channel 10 that is larger on the running side of the fabric than on the paper side. In the drainage channel 10 on the left side of FIG. 1, the interstice at the top of the figure (representing the paper side of the fabric and formed by a combination of top MD yarns, top CMD yarns, and binding yarns) is smaller than the interstice at the bottom of the figure (representing the running side of the fabric and formed by a combination of bottom MD yarns and bottom CMD yarns). Conversely, in the drainage channel 20 on the right side of the figure, the interstice at the top of the figure is larger than the interstice at the bottom of the figure. The arrows represent drainage speed. In the drainage channel 20 on the right, the slower initial drainage speed can result in smoother overall drainage, and the higher subsequent drainage speed can reduce vacuum pressure and facilitate drying. These fabrics can exhibit little to no retention loss and a reduced rewetting effect with a reduced void volume. All of these factors can produce an improved paper sheet, produced under improved conditions.

In particular, it has been determined that fabrics having a "Channel Factor" of greater than 2 can provide significantly better drainage to a fabric. As used herein, the term "Channel Factor" (CF) can be calculated according to equation (1):

$$CF=(PSMW/PSML)\times(SOA\ \%\ PS/SOA\ \%\ RS) \quad (1)$$

wherein

PSMW=paper side mesh width (i.e., the CMD width of a hole or interstice between adjacent paper side MD yarns);

PSML=paper side mesh length (i.e., the MD width of a hole or interstice between adjacent paper side CMD yarns);

SOA % PS=surface open area on the paper side; and

SOA % RS=surface open area on the running side.

Figure 2A:
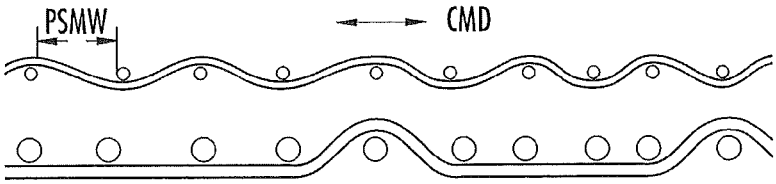
FIG. 2A is a cross-machine direction section view of a typical top CMD yarn and a bottom CMD yarn of a papermaking fabric.
Figure 2B:
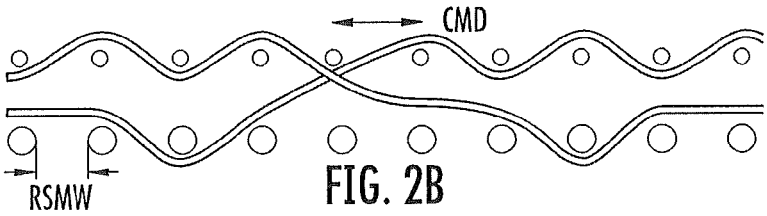
FIG. 2B is a cross-machine direction section view of a typical stitching yarn pair of the fabric of FIG. 2A.
Figure 2C:
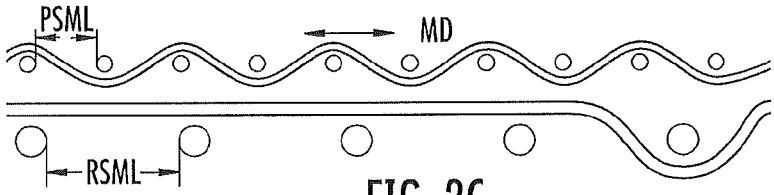
FIG. 2C is a machine direction section view of a typical top MD yarn and bottom MD yarn of the fabric of FIG. 2A.
Figure 2D:
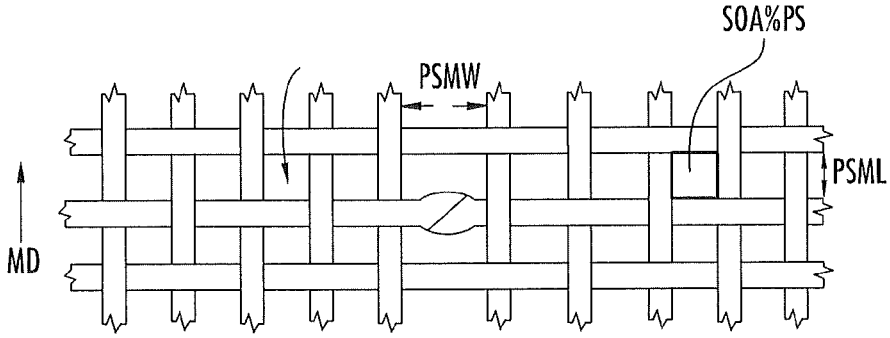
FIG. 2D is a top view of a small portion of the top fabric layer of the fabric of FIG. 2A.
Figure 2E:
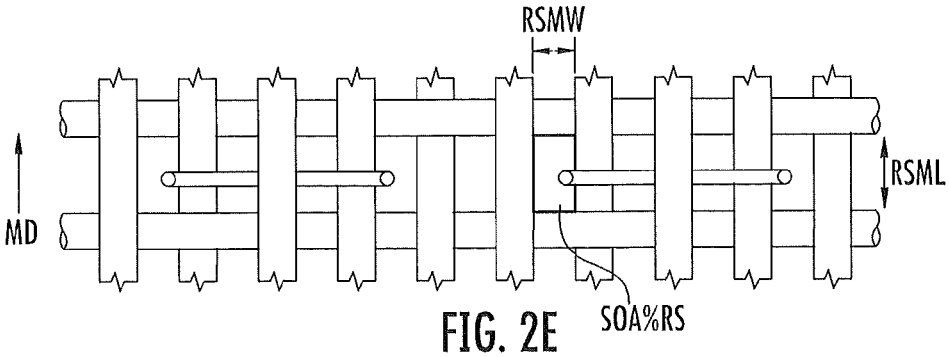
FIG. 2E is a top view of a small portion of the bottom fabric layer of the fabric of FIG. 2A.

FIGS. 2A-2E illustrate the parameters of Equation (1). FIGS. 2A and 2B are section views of a triple layer fabric taken along the cross-machine direction (i.e., showing CMD yarns), and FIG. 2C is a section view of the fabric taken along the machine direction (showing MD yarns). FIG. 2D is a top view of a portion of the top fabric layer, and FIG. 2E is a top view of a portion of the bottom fabric layer. It can be seen in FIG. 2D that the dimension "PSMW" refers to the distance between adjacent top MD yarns, and the dimension "PSML" refers to the distance between adjacent top CMD yarns (or, in the illustrated instance, between top CMD yarns and their adjacent binding yarns, because the binding yarns form part of the weave pattern of the top fabric layer). "Surface Open Area %" is the percentage of a mesh that is open, i.e., not occupied by a yarn. For the top fabric layer, it can be calculated as:

$$SOA\ \%\ PS=1-[(\#\text{ of top } MD \text{ yarns/cm}\times\text{diameter of top } MD \text{ yarns(cm)})+(\#\text{ of top } CMD \text{ yarns/cm}\times\text{diameter of top } CMD \text{ yarns(cm)})-(\#\text{ of intersection points/cm}^2)(\text{diameter of top } MD \text{ yarns})(\text{diameter of top } CMD \text{ yarns(cm)})]$$

A similar calculation can be performed for the SOA % RS for the bottom fabric layer, replacing top MD and CMD yarns with bottom MD and CMD yarns.

The yarn and mesh sizes for an exemplary engineered drainage fabric (Fabric D) are shown in Table 1 below, wherein it is compared to three other existing triple layer fabrics (Fabrics A, B and C). Each of the fabrics has a plain weave paper surface formed by top MD (warp) yarns, top CMD (weft) yarns and CMD binding yarn pairs. In calculating "weft ratio," a pair of CMD binding yarns is considered to be the equivalent of one top CMD yarn, but is not included as a bottom CMD yarn.

TABLE 1

| | | warp | | | | weft | | | |
|---|---|---|---|---|---|---|---|---|---|
| | | count | | diameter | | count | | diameter | |
| Design | weft ratio | PS/cm | RS/cm | PS (mm) | RS (mm) | PS/cm | RS/cm | PS (mm) | RS (mm) |
| Conventional CMD-Stitched Weaves | | | | | | | | | |
| A | 2:1 | 30 | 30 | 0.13 | 0.21 | 37 | 18.5 | 0.13 | 0.30 |
| B | 3:2 | 30 | 30 | 0.13 | 0.21 | 36 | 24.0 | 0.13 | 0.27 |
| C | 1:1 | 30 | 30 | 0.13 | 0.21 | 32 | 32 | 0.13 | 0.20 |
| Engineered Channel Weaves | | | | | | | | | |
| D | 2:1 | 25 | 36 | 0.13 | 0.19 | 40 | 20 | 0.13 | 0.30 |

The analytical results are shown in Table 2 below.

TABLE 2

| | SOA [%] | | Holes | | | | Channel Factor (CF) | | |
|---|---|---|---|---|---|---|---|---|---|
| Design | PS | RS | Length | Width | W:L | SP/Holes | PS | RS | Overall CF |
| A | 31.7 | 28.8 | 0.140 | 0.203 | 1.450 | 1110 | 46.0 | 28.8 | 1.6 |
| B | 34.0 | 27.4 | 0.148 | 0.203 | 1.376 | 1080 | 46.8 | 27.4 | 1.7 |
| C | 35.6 | 27.5 | 0.183 | 0.203 | 1.114 | 960 | 39.7 | 27.5 | 1.4 |

| | SOA [%] | | Holes | | | | Channel Factor | | |
|---|---|---|---|---|---|---|---|---|---|
| Design | PS | RS | Length | Width | W:L | SP/Holes | PS | RS | Overall CF |
| D | 33.0 | 24.0 | 0.120 | 0.270 | 2.250 | 1000 | 74.3 | 24.0 | 3.1 |

It can be seen that in the engineered channel design (D), the CF is 3.1, whereas the other fabrics have a CF of 1.7 or less. The higher CF is largely a consequence of a much higher PSMW/PSML ratio than is present in the conventional fabrics (A, B, C). The higher PSMW/PSML ratio can increase the size of the drainage channels in the paper side of the fabric while still providing excellent fiber support. As a result of the higher CF, the engineered channel design may provide improved drainage characteristics.

In some embodiments, the CF of the fabric may be greater than 2.0, greater than 2.25, greater than 2.5, greater than 2.75, or even greater than 3.0, depending on the weave pattern and the diameters of the yarns employed in the fabric. In some embodiments, the CF may not exceed 4.0, may not exceed 4.5, or may not exceed 5.0, or may not exceed 6.0, once again depending on the weave pattern and the diameters of the yarns employed in the fabric.

It has also been determined that papermaking fabrics can be analyzed in terms of a "Drainage Factor". The Drainage Factor (DF) of a fabric can be calculated as follows:

$$DF = \text{Warp coverage RS}(\%)/\text{warp coverage PS}(\%) \quad (2)$$

wherein

Warp coverage RS(%)=RS warp count/cm×RS warp diameter (mm)×10

Warp coverage PS(%)=PS warp count/cm×PS warp diameter (mm)×10

The yarn sizes and weave meshes of some exemplary conventional and inventive fabrics are shown in Table 3 below. In each instance the fabrics are triple layer fabrics with CMD stitching yarns. Fabrics G, H and I are conventional fabrics with top MD/bottom MD yarn ratios (i.e., warp ratios) of 1:1. Fabrics J, K and L are engineered drainage fabrics with warp ratios of less than 1.0.

TABLE 3

EDC - Drainage channel definition

| | warp ratio | | warp count | | warp diameters | | Warp cover | | DF RS:PS |
|---|---|---|---|---|---|---|---|---|---|
| Fabric | PS | RS | PS/cm | RS/cm | PS ∅ | RS ∅ | PS % | RS % | % |
| G | 1 | 1 | 40 | 40 | 0.10 | 0.16 | 40 | 64 | 1.60 |
| H | 1 | 1 | 33 | 33 | 0.13 | 0.18 | 43 | 59 | 1.38 |
| I | 1 | 1 | 36 | 36 | 0.11 | 0.18 | 40 | 65 | 1.64 |
| J | 1 | 2 | 25 | 50 | 0.13 | 0.15 | 33 | 75 | 2.31 |
| K | 2 | 3 | 24 | 36 | 0.13 | 0.19 | 31 | 68 | 2.19 |
| L | 2 | 3 | 34.7 | 52 | 0.10 | 0.14 | 35 | 73 | 2.10 |

It can be seen that the engineered drainage fabrics J, K and L all have Drainage Factors of greater than 2.0. This increased drainage factor is a consequence of the combination of a higher warp count on the running side than the paper side (i.e., more bottom MD yarns than top MD yarns) and a larger warp diameter on the running side than the paper side. This arrangement can encourage improved drainage in the manner discussed above.

In some embodiments, the DF of the inventive fabrics may be higher than 2.0, in additional embodiments higher than 2.5, in others higher than 3.0, and in still others higher than 3.5. In some embodiments the DF is lower than 6.0, in others lower than 5.0 and in still others lower than 4.0.

Table 4 sets forth data on drainage holes for the fabrics G-L.

TABLE 4

| | PS drainage hole orientation | | | RS drainage hole orientation | | |
|---|---|---|---|---|---|---|
| Fabric | warp 1/cm | weft 1/cm | W:L | warp 1/cm | weft 1/cm | W:L |
| G | 40 | 40 | 1.00 | 40 | 20 | 0.50 |
| H | 33 | 44 | 1.33 | 33 | 22 | 0.67 |
| I | 36 | 40 | 1.11 | 36 | 20 | 0.56 |
| J | 25 | 48 | 1.92 | 50 | 24 | 0.48 |
| K | 24 | 40 | 1.67 | 36 | 20 | 0.56 |
| L | 36 | 40 | 1.11 | 52 | 20 | 0.38 |

It can be seen that the conventional fabrics have paper side hole W/L ratios of 1.0 or greater and running side hole W/L ratios of less than 1.0.

Those skilled in this art will recognize that this concept is most applicable to triple layer fabrics, which have paper side and running side MD yarns and paper side and running side CMD yarns, although other variations, such as those in which MD or CMD yarns function as both paper side yarns and stitching yarns (see, e.g., U.S. Pat. Nos. 5,967,195 and 7,219,701, the disclosures of which are hereby incorporated herein in their entireties). In such cases, the PSMW and PSML are measured between the paper side yarns and the stitching yarns that form a portion of the papermaking weave, and the SOA % PS and SOA % RS include the stitching yarns in the calculation thereof. In other embodiments one or more of top MD yarns, top CMD yarns, bottom MD yarns and bottom CMD yarns may be replaced by binding yarns that are integrated into the weave pattern. Exemplary weave patterns of this type are illustrated and described in U.S. Pat. No. 5,881,764.

The form of the yarns utilized in fabrics of the present invention can vary, depending upon the desired properties of the final papermaker's fabric. For example, the yarns may be monofilament yarns, flattened monofilament yarns as described above, multifilament yarns, twisted multifilament or monofilament yarns, spun yarns, or any combination thereof. Also, the materials comprising yarns employed in the fabric of the present invention may be those commonly used in papermaker's fabric. For example, the yarns may be formed of polyester, polyamide (nylon), polypropylene, aramid, or the like. The skilled artisan should select a yarn material according to the particular application of the final fabric. In particular, round monofilament yarns formed of polyester or polyamide may be preferred.

Pursuant to another aspect of the present invention, methods of making paper are provided. Pursuant to these methods, one of the exemplary papermaker's forming fabrics described herein is provided, and paper is then made by applying paper stock to the forming fabric and by then removing moisture from the paper stock. As the details of how the paper stock is applied to the forming fabric and how moisture is removed from the paper stock is well understood by those of skill in the art, additional details regarding this aspect of the present invention need not be provided herein.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined herein in the following claims.

That which is claimed is:

1. A papermaking forming fabric, comprising:

a set of top MD yarns;

a set of top CMD yarns interwoven with the top MD yarns to form a top fabric layer;

a set of bottom MD yarns;

a set of bottom CMD yarns interwoven with the bottom MD yarns to form a bottom fabric layer; and a set of binding yarns that interweaves with and binds together the top and bottom fabric layers;

wherein the fabric has a Channel Factor (CF) of greater than 2.0, the CF being defined in Equation (1) as:

$$CF=(PSMW/PSML)\times(SOA\ \%\ PS/SOA\ \%\ RS) \quad (1)$$

wherein:

PSMW=the CMD width of an interstice between adjacent top MD yarns;

PSML=the MD width of an interstice between adjacent top CMD yarns;

SOA % PS=surface open area in the top fabric layer;

SOA % RS=surface open area in the bottom fabric layer; and PSMW/PSML>1.

2. The papermaking fabric defined in claim 1, wherein the binding yarns are CMD binding yarns.

3. The papermaking fabric defined in claim 1, wherein:

RSMW=the CMD width of an interstice between adjacent bottom MD yarns;

RSML=the MD width of an interstice between adjacent bottom CMD yarns; and

RSMW/RSML<1.

4. The papermaking fabric defined in claim 1, wherein the fabric has a Drainage Factor (DF) of greater than 2.0, the DF being defined in Equation (2) as:

$$DF=\text{Warp coverage RS}(\%)/\text{warp coverage PS}(\%) \quad (2)$$

wherein:

Warp coverage RS(%)=bottom MD yarns/cm×bottom MD yarn diameter (mm)×10; and

Warp coverage PS(%)=top MD yarns/cm×top MD yarn diameter (mm)×10.

5. The papermaking fabric defined in claim 1, wherein the set of bottom MD yarns includes a first number of bottom MD yarns, the set of top MD yarns includes a second number of top MD yarns, and the first number is higher than the second number.

6. The papermaking fabric defined in claim 1, wherein the set of top CMD yarns includes a third number of top CMD yarns, the set of stitching yarns comprises CMD stitching yarns, is arranged in pairs, and includes a fourth number of stitching yarn pairs, and the set of bottom CMD yarns includes a fifth number of bottom CMD yarns, and wherein the sum of the third and fourth number is greater than the fifth number.

7. A papermaking forming fabric, comprising:

a set of top MD yarns;

a set of top CMD yarns interwoven with the top MD yarns to form a top fabric layer;

a set of bottom MD yarns;

a set of bottom CMD yarns interwoven with the bottom MD yarns to form a bottom fabric layer; and a set of binding yarns that interweaves with and binds together the top and bottom fabric layers;

wherein the fabric has a Drainage Factor (DF) of greater than 2.0, the DF being defined in Equation (2) as:

$$DF=\text{Warp coverage RS}(\%)/\text{warp coverage PS}(\%) \quad (2)$$

wherein:

Warp coverage RS(%)=bottom MD yarns/cm×bottom MD yarn diameter (mm)×10;

Warp coverage PS(%)=top MD yarns/cm×top MD yarn diameter (mm)×10; PSMW=the CMD width of an interstice between adjacent top MD yarns;

PSML=the MD width of an interstice between adjacent top CMD yarns;

RSMW=the CMD width of an interstice between adjacent bottom MD yarns;

RSML=the MD width of an interstice between adjacent bottom CMD yarns;

and RSMW/RSML<1, and PSMW>PSML.

8. The papermaking fabric defined in claim 7, wherein the binding yarns are CMD binding yarns.

9. The papermaking fabric defined in claim 7, wherein the set of bottom MD yarns includes a first number of bottom MD yarns, the set of top MD yarns includes a second number of top MD yarns, and the first number is higher than the second number.

10. The papermaking fabric defined in claim 7, wherein the set of top CMD yarns includes a third number of top CMD yarns, the set of stitching yarns comprises CMD stitching yarns, is arranged in pairs, and includes a fourth number of stitching yarn pairs, and the set of bottom CMD yarns includes a fifth number of bottom CMD yarns, and wherein the sum of the third and fourth number is greater than the fifth number.

* * * * *